US007691172B2

(12) United States Patent
Imori et al.

(10) Patent No.: US 7,691,172 B2
(45) Date of Patent: Apr. 6, 2010

(54) METALLIC POWDER FOR POWDER METALLURGY WHOSE MAIN COMPONENT IS IRON AND IRON-BASED SINTERED BODY

(75) Inventors: Toru Imori, Ibaraki (JP); Atsushi Nakamura, Ibaraki (JP); Yasushi Narusawa, Ibaraki (JP); Masataka Yahagi, Ibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 160 days.

(21) Appl. No.: 11/574,275

(22) PCT Filed: Aug. 5, 2005

(86) PCT No.: PCT/JP2005/014415

§ 371 (c)(1),
(2), (4) Date: Feb. 26, 2007

(87) PCT Pub. No.: WO2006/025187

PCT Pub. Date: Mar. 9, 2006

(65) Prior Publication Data

US 2007/0292298 A1 Dec. 20, 2007

(30) Foreign Application Priority Data

Aug. 30, 2004 (JP) ..... 2004-249731

(51) Int. Cl.
*B22F 1/00* (2006.01)
*B22F 3/12* (2006.01)

(52) U.S. Cl. ..... 75/231; 75/252; 419/37

(58) Field of Classification Search ..... 75/252, 75/231; 419/36, 37, 65
See application file for complete search history.

(56) References Cited

U.S. PATENT DOCUMENTS

| | | | | |
|---|---|---|---|---|
| 2,001,134 | A * | 5/1935 | Hardy | 419/36 |
| 2,307,343 | A * | 1/1943 | Whipple | 252/62.55 |
| 2,354,218 | A | 7/1944 | Murray | |
| 2,593,943 | A | 4/1952 | Wainer | |
| 2,799,080 | A | 7/1957 | Duckworth | |
| 3,660,288 | A | 5/1972 | Hansen | |
| 4,000,982 | A | 1/1977 | Ueda | |
| 4,834,800 | A | 5/1989 | Semel | |
| 5,308,702 | A * | 5/1994 | Furukimi et al. | 428/403 |
| 5,330,792 | A * | 7/1994 | Johnson et al. | 427/217 |
| 5,415,791 | A | 5/1995 | Chou et al. | |
| 5,595,608 | A | 1/1997 | Takebuchi et al. | |
| 5,980,819 | A * | 11/1999 | Nakagawa et al. | 419/27 |
| 6,013,723 | A | 1/2000 | Akao | |
| 6,132,487 | A | 10/2000 | Mori | |
| 6,261,336 | B1 | 7/2001 | Behi et al. | |
| 7,217,310 | B2 | 5/2007 | Yahagi et al. | |
| 7,347,969 | B2 | 3/2008 | Yahagi et al. | |
| 2005/0166709 | A1 | 8/2005 | Yahagi et al. | |
| 2005/0271540 | A1 | 12/2005 | Yahagi et al. | |
| 2007/0231180 | A1 | 10/2007 | Imori et al. | |
| 2008/0138642 | A1 | 6/2008 | Yahagi et al. | |

FOREIGN PATENT DOCUMENTS

| | | | |
|---|---|---|---|
| JP | 04-176801 | A | 6/1992 |
| JP | 04-191301 | A | 7/1992 |
| JP | 06-290919 | A | 10/1994 |
| JP | 10-046201 | A | 2/1998 |
| JP | 2003-003201 | A | 1/2003 |
| WO | 2004/024372 | A1 | 3/2004 |

OTHER PUBLICATIONS

JP 06-290919, Oct. 18, 1994, machine translation (12 pages).*
JP 10-046201, Feb. 17, 1998, machine translation (12 pages).*
ESP@CENET Database, English Abstract of JP 61-034101, Feb. 18, 1986.

* cited by examiner

*Primary Examiner*—Roy King
*Assistant Examiner*—Ngoclan T Mai
(74) *Attorney, Agent, or Firm*—Howson & Howson LLP

(57) ABSTRACT

Provided is iron-based metal powder for powder metallurgy including a metallic soap containing at least one or more types selected from a group of Ag, Au, Bi, Co, Cu, Mo, Ni, Pd, Pt, Sn, Te and W having a higher standard oxidization potential than iron, and an iron sintered body having a rust prevention function, wherein at least one or more types of metallic soap selected from a group of Ag, Au, Bi, Co, Cu, Mo, Ni, Pd, Pt, Sn, Te and W having a higher standard oxidization potential than iron is added to iron-based metal powder for powder metallurgy, and sintering is performed thereto. As a result, obtained is mixed powder for powder metallurgy capable of improving the rust prevention effect easily without having to hardly change the conventional processes.

13 Claims, No Drawings

METALLIC POWDER FOR POWDER METALLURGY WHOSE MAIN COMPONENT IS IRON AND IRON-BASED SINTERED BODY

BACKGROUND OF THE INVENTION

The present invention generally relates to mixed powder for powder metallurgy to be used in the manufacture of sintered parts, brushes and so on, and particularly relates to iron-based powder for powder metallurgy suitable for the manufacture of iron sintered parts superior in rust prevention performance to be used as solid lubricants and the like, as well as to an iron sintered body.

Generally speaking, iron powder used for the purposes of sintered machine parts, sintered oil retaining bearings, metal graphite brushes and so on rusts easily, and is generally used by mixing an organic rust preventive agent such as benzotriazole therein.

Nevertheless, although such an organic rust preventive agent has a temporary rust prevention effect, since it dissolves or becomes vaporized at a temperature of 500° C. or higher, it will disappear at an ordinarily used sintering temperature of 700° C. or higher. Therefore, after sintering, this will become the same state as when no rust prevention measures are taken, and there is a problem in that the iron powder will rust extremely easily.

Meanwhile, in order to obtain rust prevention properties after sintering, proposals have been made for obtaining a composite powder sintered body by mixing minute amounts of metal powder such as zinc, bismuth or lead with the iron-based sintering powder, or mixing the vapor thereof to the gas upon sintering.

Nevertheless, since this will increase new processes, there is a problem in that the manufacturing process will become complex and, as a result, there will be variations in the quality.

As a conventional powder metallurgical additive, there is an additive having organic cobalt metal soap as its component, and technology is disclosed for manufacturing a sintered body by adding and mixing this at 0.1 to 2.0% by weight, and molding and sintering this mixed powder (e.g., refer to Japanese Patent Laid-Open Publication No. H10-46201).

Further, disclosed is technology of adding and mixing metal stearate to, and thereafter dry-pulverizing, a rare earth-iron-boron permanent magnet alloy coarse powder mainly composed in atomic % of rare earth element R (among rare-earth elements containing Y, one or two or more elements are combined) of 10 to 25%, boron B of 1 to 12%, and the remaining part consisting of iron Fe, wherein a part of Fe is replaced at least with one or more kinds of elements selected from Co, Ni, Al, Nb, Ti, W, Mo, V, Ga, Zn and Si in a range of 0 to 15%, if necessary (e.g., refer to Japanese Patent Laid-Open Publication No. H6-290919).

Further, disclosed is a molding improving agent which consists of alloy powder for permanent magnets obtained by compounding at least 1 type of stearate to at least one type selected from polyoxyethylene alkyl ether, polyoxyethylene monofatty acid ester and polyoxyethylene alkylallylether at a compound ratio of 1/20 to 5/1 (e.g., refer to Japanese Patent Laid-Open Publication No. S61-34101).

SUMMARY OF THE INVENTION

An object of the present invention is to obtain iron-based powder for powder metallurgy capable of improving the rust prevention effects easily without having to hardly change the conventional processes, and an iron sintered body having a rust prevention function obtained by sintering such iron-based powder for powder metallurgy.

As a result of intense study to overcome the foregoing problems, the present inventors discovered that, by mixing a specific additive upon molding iron-based sintering powder, an effect is yielded as a molding lubricant, metal components can be dispersed evenly, and rust prevention effects can be significantly improved in the parts even after sintering.

Based on the foregoing discovery, the present invention provides: 1) iron-based metal powder for powder metallurgy including a metallic soap containing at least one or more types selected from a group of Ag, Au, Bi, Co, Cu, Mo, Ni, Pd, Pt, Sn, Te and W having a higher standard oxidization potential than iron; and 2) an iron sintered body having a rust prevention function, wherein at least one or more types of metallic soap selected from a group of Ag, Au, Bi, Co, Cu, Mo, Ni, Pd, Pt, Sn, Te and W having a higher standard oxidization potential than iron is added to iron-based metal powder for powder metallurgy, and sintering is performed thereto.

EFFECT OF THE INVENTION

As described above, as a result of obtaining mixed powder for power metallurgy by adding the metallic soap of the present invention to iron-based metal powder for powder metallurgy, the rust prevention effect of sintered bodies such as sintered machine parts, sintered oil retaining bearings and metal graphite brushes can be exponentially improved without changing the conventional sintered body manufacturing process.

DETAILED DESCRIPTION OF THE INVENTION

In devising the present invention, the present inventors took particular note of minute amounts of zinc stearate to be added as a lubricant upon molding powder. Nevertheless, since this zinc stearate dissipates during sintering and has high corrosiveness, there is a problem in that it will damage the sintering furnace, and the rust prevention effect is no different than a case without any additives.

As described above, since this zinc stearate is mainly used as a lubricant during molding, the present inventors sought for a material having the same lubricant function as zinc stearate and also capable of improving the rust prevention effect not found in zinc stearate.

As a result, obtained was a method of adding a metallic soap having a higher standard oxidization potential (standard oxidization potential of $Fe/Fe^{2+}$ is −0.440V), which possesses a function as a molding lubricant equal to zinc stearate and is capable of improving the rust prevention effect even after sintering, to powder for powder metallurgy. Thereby, the rust prevention effect of a sintered body can be exponentially improved without having to change the conventional sintered body manufacturing process.

As the metal having a higher standard oxidization potential than iron, one or more types of metal selected from a group of Ag, Au, Bi, Co, Cu, Mo, Ni, Pb, Pt, Sn, Te and W is used. Pb and Cd are not used since these cause problems of environmental pollution. It has been discovered that these soaps are capable of yielding extremely superior rust prevention effects.

Further, as soaps, metallic soap stearate, metallic soap propionate, metallic soap naphthenate and so on may be used as the metallic soap.

It is desirable that these metallic soaps are generally added at 0.1 to 2.0 parts by weight to iron-based metal powder for powder metallurgy 100 parts by weight.

Nevertheless, this additive amount may be changed according to the type of sintered body, and does not necessarily have to be limited to the foregoing additive amount. In other words, the additive amount may be arbitrarily set within a scope that is capable of maintaining the characteristics of the target sintered body.

Further, the powder for powder metallurgy to be added to these metallic soaps is not necessarily limited to iron powder, and other powder where iron is coated on the metal powder or powder mixed with iron may also be employed for improving the rust prevention effect.

EXAMPLES

Next, the Examples are explained. Further, these Examples are merely illustrative, and the present invention shall in no way be limited thereby. In other words, the present invention shall include all other modes or modifications other than these Examples within the scope of the technical spirit of this invention.

Example 1

Synthesized tin stearate (Sn content 12.0% by weight) was pulverized minutely and passed through a sieve in order to obtain fine powder of 250 mesh or less.

Copper powder 3.0 wt %, graphite powder 1.0 wt %, and the foregoing tin stearate (abbreviated as "St.Sn" in Table 1) 0.8 wt % (not included in the total number) were mixed with iron powder (Hoganas reduced iron powder) 96 wt %. This mixed powder (fill of 1.52 to 2.53 g) was molded into a specimen of approximately 10.03 mmϕ×2.70 to 4.55 mmt at a molding pressure of 6 t/cm$^2$.

In order to judge the moldability, details regarding the relationship of the green density (GD) and molding pressure of each compact are shown in Table 1 (samples No. 1 to 8).

The moldability of mixed powder was evaluated regarding these specimens, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 1.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 1

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 1 | St. Sn | 1.5 | 6 | 420 | 10.03 | 2.70 | 1.52 | 7.13 | 10.03 | 2.71 | 1.50 | 7.01 |
| 2 | | 1.5 | 6 | 420 | 10.03 | 2.74 | 1.53 | 7.07 | 10.03 | 2.74 | 1.52 | 7.02 |
| 3 | | 2.5 | 6 | 420 | 10.03 | 4.50 | 2.51 | 7.06 | 10.03 | 4.50 | 2.47 | 6.95 |
| 4 | | 2.5 | 6 | 420 | 10.03 | 4.49 | 2.50 | 7.05 | 10.04 | 4.49 | 2.46 | 6.92 |
| 5 | | 2.5 | 6 | 420 | 10.03 | 4.54 | 2.53 | 7.06 | 10.03 | 4.54 | 2.51 | 7.00 |
| 6 | | 2.5 | 6 | 420 | 10.03 | 4.53 | 2.53 | 7.07 | 10.03 | 4.53 | 2.50 | 6.99 |
| 7 | | 2.5 | 6 | 420 | 10.03 | 4.55 | 2.53 | 7.04 | 10.03 | 4.53 | 2.50 | 6.99 |
| 8 | | 2.5 | 6 | 420 | 10.03 | 4.52 | 2.52 | 7.06 | 10.05 | 4.53 | 2.49 | 6.93 |

TABLE 2

| | | Oxidation Resistance | | |
|---|---|---|---|---|
| | Additive | After 96 hours | After 168 hours | After 336 hours |
| Example 1 | Sn Stearate | * No Discoloration | Slight Discoloration | Slight Discoloration |
| Example 2 | Ag Stearate | * No Discoloration | Slight Discoloration | Slight Discoloration |
| Example 3 | Bi Stearate | * No Discoloration | Slight Discoloration | Slight Discoloration |
| Example 4 | Co Stearate | * No Discoloration | Slight Discoloration | Slight Discoloration |
| Comparative Example 1 | Zn Stearate | A Little Discoloration | x Severe Discoloration | x Severe Discoloration |
| Comparative Example 2 | Sr Stearate | x Severe Discoloration | x Severe Discoloration | x Severe Discoloration |
| Comparative Example 3 | Ba Stearate | A Little Discoloration | x Severe Discoloration | x Severe Discoloration |
| Comparative Example 4 | Re Stearate | x Severe Discoloration | x Severe Discoloration | x Severe Discoloration |
| Comparative Example 5 | Additive Free | A Little Discoloration | x Severe Discoloration | x Severe Discoloration |

Example 2

Synthesized silver stearate (Ag content 12.0% by weight) was pulverized minutely and passed through a sieve in order to obtain fine powder of 250 mesh or less.

Copper powder 3.0 wt %, graphite powder 1.0 wt %, and the foregoing silver stearate (abbreviated as "St.Ag" in Table 3) 0.4 wt % (not included in the total number) were mixed with iron powder (Hoganas reduced iron powder) 96 wt %. This mixed powder (fill of 1.5 to 2.5 g) was molded into a specimen of approximately 10.01 mmϕ×2.63 to 4.47 mmt at a molding pressure of 6 t/cm$^2$.

In order to judge the moldability, details regarding the relationship of the green density (GD) and molding pressure of each compact are shown in Table 3 (samples No. 11 to 18).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 3.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 3

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 11 | St. Ag | 1.5 | 6 | 420 | 10.01 | 2.63 | 1.49 | 7.20 | 10.01 | 2.66 | 1.47 | 7.03 |
| 12 | | 1.5 | 6 | 420 | 10.01 | 2.68 | 1.52 | 7.21 | 10.02 | 2.66 | 1.46 | 6.96 |
| 13 | | 2.5 | 6 | 420 | 10.01 | 4.42 | 2.50 | 7.19 | 10.01 | 4.47 | 2.47 | 7.03 |
| 14 | | 2.5 | 6 | 420 | 10.01 | 4.46 | 2.52 | 7.18 | 10.01 | 4.51 | 2.48 | 6.99 |
| 15 | | 2.5 | 6 | 420 | 10.01 | 4.43 | 2.50 | 7.17 | 10 | 4.45 | 2.46 | 7.04 |
| 16 | | 2.5 | 6 | 420 | 10.01 | 4.47 | 2.52 | 7.17 | 10 | 4.49 | 2.47 | 7.01 |
| 17 | | 2.5 | 6 | 420 | 10.01 | 4.44 | 2.51 | 7.19 | 10.01 | 4.5 | 2.47 | 6.98 |
| 18 | | 2.5 | 6 | 420 | 10.01 | 4.41 | 2.49 | 7.18 | 10.01 | 4.49 | 2.48 | 7.02 |

Example 3

Synthesized bismuth stearate (Bi content 12.0% by weight) was pulverized minutely and passed through a sieve in order to obtain fine powder of 250 mesh or less.

Copper powder 3.0 wt %, graphite powder 1.0 wt %, and the foregoing bismuth stearate (abbreviated as "St.Bi" in Table 4) 0.4 wt % (not included in the total number) were mixed with iron powder (Hoganas reduced iron powder) 96 wt %. This mixed powder (fill of 1.5 to 2.5 g) was molded into a specimen of approximately 10.42 to 10.44 mmϕ×2.64 to 4.44 mmt at a molding pressure of 6 t/cm$^2$.

In order to judge the moldability, details regarding the relationship of the green density (GD) and molding pressure of each compact are shown in Table 4 (samples No. 21 to 30).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 4.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

Incidentally, although the same process was performed with bismuth propionate and bismuth naphthenate under the same conditions in addition to bismuth stearate, similar results were obtained.

TABLE 4

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 21 | St. Bi | 1.5 | 6 | 420 | 10.44 | 2.74 | 1.55 | 6.61 | 10.45 | 2.60 | 1.53 | 6.86 |
| 22 | | 1.5 | 6 | 420 | 10.44 | 2.64 | 1.51 | 6.69 | 10.43 | 2.58 | 1.49 | 6.76 |
| 23 | | 2.5 | 6 | 420 | 10.43 | 4.31 | 2.49 | 6.77 | 10.43 | 4.25 | 2.47 | 6.81 |
| 24 | | 2.5 | 6 | 420 | 10.44 | 4.44 | 2.51 | 6.61 | 10.42 | 4.22 | 2.47 | 6.87 |
| 25 | | 2.5 | 6 | 420 | 10.44 | 4.33 | 2.51 | 6.78 | 10.43 | 4.26 | 2.48 | 6.82 |
| 26 | | 2.5 | 6 | 420 | 10.44 | 4.31 | 2.51 | 6.81 | 10.42 | 4.25 | 2.48 | 6.85 |
| 27 | | 2.5 | 6 | 420 | 10.44 | 4.31 | 2.51 | 6.81 | 10.42 | 4.26 | 2.47 | 6.80 |
| 28 | | 2.5 | 6 | 420 | 10.44 | 4.32 | 2.52 | 6.82 | 10.43 | 4.24 | 2.48 | 6.85 |
| 29 | | 2.5 | 6 | 420 | 10.44 | 4.31 | 2.49 | 6.75 | 10.41 | 4.24 | 2.46 | 6.82 |
| 30 | | 2.5 | 6 | 420 | 10.42 | 4.27 | 2.51 | 6.90 | 10.43 | 4.24 | 2.48 | 6.85 |

Example 4

Synthesized cobalt stearate (Co content 12.0% by weight) was pulverized minutely and passed through a sieve in order to obtain fine powder of 250 mesh or less.

Copper powder 3.0 wt %, graphite powder 1.0 wt %, and the foregoing cobalt stearate (abbreviated as "St.Co" in Table 5) 0.4 wt % (not included in the total number) were mixed with iron powder (Hoganas reduced iron powder) 96 wt %. This mixed powder (fill of 1.5 to 2.5 g) was molded into a specimen of approximately 10.01 mmϕ×2.74 to 4.56 mmt at a molding pressure of 6 t/cm$^2$.

In order to judge the moldability, details regarding the relationship of the green density (GD) and molding pressure of each compact are shown in Table 5 (samples No. 31 to 38).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 5.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 5

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 31 | St. Co | 1.5 | 6 | 420 | 10.01 | 2.74 | 1.53 | 7.10 | 10.00 | 2.71 | 1.51 | 7.10 |
| 32 | | 1.5 | 6 | 420 | 10.01 | 2.75 | 1.54 | 7.12 | 10.00 | 2.74 | 1.52 | 7.07 |
| 33 | | 2.5 | 6 | 420 | 10.01 | 4.51 | 2.52 | 7.10 | 10.00 | 4.48 | 2.49 | 7.08 |
| 34 | | 2.5 | 6 | 420 | 10.01 | 4.56 | 2.55 | 7.11 | 10.00 | 4.54 | 2.52 | 7.07 |
| 35 | | 2.5 | 6 | 420 | 10.01 | 4.51 | 2.50 | 7.05 | 10.00 | 4.44 | 2.46 | 7.06 |
| 36 | | 2.5 | 6 | 420 | 10.01 | 4.53 | 2.53 | 7.10 | 10.00 | 4.50 | 2.50 | 7.08 |
| 37 | | 2.5 | 6 | 420 | 10.01 | 4.46 | 2.48 | 7.07 | 10.00 | 4.42 | 2.46 | 7.09 |
| 38 | | 2.5 | 6 | 420 | 10.01 | 4.46 | 2.47 | 7.04 | 10.00 | 4.41 | 2.44 | 7.05 |

Comparative Example 1

Zinc stearate SZ-2000 (manufactured by Sakai Chemical Industry) was used, and, as with Example 1, copper powder 3.0 wt %, graphite powder 1.0 wt %, and the foregoing zinc stearate (abbreviated as "St.Zn" in Table 6) 0.8 wt % (not included in the total number) were mixed with iron powder 96 wt %. This mixed powder (fill of 1.5 to 2.5 g) was molded into a specimen of approximately 10.02 to 10.03 mmϕ×2.75 to 4.62 mmH at a molding pressure of 6 t/cm$^2$.

In order to judge the moldability, the moldability of mixed powder was evaluated regarding these specimens under the same conditions as Example 1. Details regarding the relationship of the green density (GD) and molding pressure of each compact are shown in Table 6 (samples No. 41 to 48).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 6.

This sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 6

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 41 | St. Zn | 1.5 | 6 | 420 | 10.02 | 2.75 | 1.51 | 6.97 | 10.03 | 2.75 | 1.50 | 6.91 |
| 42 | | 1.5 | 6 | 420 | 10.03 | 2.76 | 1.53 | 7.02 | 10.03 | 2.79 | 1.51 | 6.85 |
| 43 | | 2.5 | 6 | 420 | 10.03 | 4.60 | 2.54 | 6.99 | 10.02 | 4.58 | 2.51 | 6.95 |
| 44 | | 2.5 | 6 | 420 | 10.03 | 4.57 | 2.53 | 7.01 | 10.03 | 4.56 | 2.49 | 6.91 |
| 45 | | 2.5 | 6 | 420 | 10.02 | 4.58 | 2.52 | 6.98 | 10.02 | 4.55 | 2.49 | 6.94 |
| 46 | | 2.5 | 6 | 420 | 10.03 | 4.62 | 2.55 | 6.99 | 10.03 | 4.60 | 2.52 | 6.94 |
| 47 | | 2.5 | 6 | 420 | 10.03 | 4.56 | 2.51 | 6.97 | 10.03 | 4.53 | 2.48 | 6.93 |
| 48 | | 2.5 | 6 | 420 | 10.03 | 4.57 | 2.52 | 6.98 | 10.03 | 4.56 | 2.49 | 6.91 |

Comparative Example 2

Strontium stearate (St.Sr) was used, and, as with Example 1, graphite powder 1.0 wt % and the foregoing strontium stearate (abbreviated as "St.Sr" in Table 7) 0.8 wt % (not included in the total number) were mixed with iron powder 99 wt %. This mixed powder (fill of 1.5 to 2.5 g) was molded into a specimen of approximately 10.02 to 10.03 mmϕ×2.75 to 4.59 mmt at a molding pressure of 6 t/cm$^2$.

In order to judge the moldability, the moldability of mixed powder was evaluated regarding these specimens under the same conditions as Example 1. Details regarding the relationship of the green density (GD) and molding pressure of each compact are shown in Table 7 (samples No. 51 to 58).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 7.

As with Example 1, this sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 7

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 51 | St. Sr | 1.5 | 6 | 420 | 10.03 | 2.75 | 1.52 | 7.00 | 10.03 | 2.75 | 1.50 | 6.91 |
| 52 | | 1.5 | 6 | 420 | 10.02 | 2.76 | 1.51 | 6.94 | 10.03 | 2.77 | 1.49 | 6.81 |
| 53 | | 2.5 | 6 | 420 | 10.03 | 4.57 | 2.52 | 6.98 | 10.04 | 4.56 | 2.49 | 6.90 |
| 54 | | 2.5 | 6 | 420 | 10.03 | 4.55 | 2.51 | 6.99 | 10.03 | 4.55 | 2.47 | 6.87 |
| 55 | | 2.5 | 6 | 420 | 10.02 | 4.57 | 2.51 | 6.97 | 10.03 | 4.56 | 2.48 | 6.89 |
| 56 | | 2.5 | 6 | 420 | 10.02 | 4.54 | 2.50 | 6.99 | 10.03 | 4.53 | 2.46 | 6.88 |
| 57 | | 2.5 | 6 | 420 | 10.03 | 4.54 | 2.49 | 6.94 | 10.04 | 4.52 | 2.46 | 6.88 |
| 58 | | 2.5 | 6 | 420 | 10.03 | 4.59 | 2.52 | 6.95 | 10.03 | 4.57 | 2.49 | 6.90 |

Comparative Example 3

Barium stearate (St.Ba) was used, and, as with Example 1, graphite powder 1.0 wt % and the foregoing barium stearate (abbreviated as "St.Ba" in Table 8) 0.8 wt % (not included in the total number) were mixed with iron powder 99 wt %. This mixed powder (fill of 1.5 to 2.5 g) was molded into a specimen of approximately 10.02 to 10.04 mmϕ×2.78 to 4.61 mmH at a molding pressure of 6 t/cm$^2$.

In order to judge the moldability, details regarding the relationship of the green density (GD) and molding pressure of each compact are shown in Table 8 (samples No. 61 to 68).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 8.

As with Example 1, this sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 8

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 61 | St. Ba | 1.5 | 6 | 420 | 10.03 | 2.78 | 1.51 | 6.88 | 10.03 | 2.79 | 1.49 | 6.76 |
| 62 | | 1.5 | 6 | 420 | 10.04 | 2.81 | 1.51 | 6.79 | 10.03 | 2.82 | 1.50 | 6.74 |
| 63 | | 2.5 | 6 | 420 | 10.03 | 4.61 | 2.51 | 6.89 | 10.03 | 4.62 | 2.48 | 6.80 |
| 64 | | 2.5 | 6 | 420 | 10.03 | 4.61 | 2.51 | 6.89 | 10.04 | 4.62 | 2.48 | 6.78 |
| 65 | | 2.5 | 6 | 420 | 10.03 | 4.59 | 2.50 | 6.90 | 10.04 | 4.59 | 2.48 | 6.83 |
| 66 | | 2.5 | 6 | 420 | 10.03 | 4.57 | 2.50 | 6.93 | 10.03 | 4.58 | 2.47 | 6.83 |
| 67 | | 2.5 | 6 | 420 | 10.02 | 4.56 | 2.49 | 6.93 | 10.03 | 4.56 | 2.46 | 6.83 |
| 68 | | 2.5 | 6 | 420 | 10.03 | 4.56 | 2.48 | 6.89 | 10.03 | 4.57 | 2.46 | 6.82 |

Comparative Example 4

Stearate (rare earth such as Ce, La, Nd, Pr) was used, and, as with Example 1, graphite powder 1.0 wt % and the foregoing stearic acid (St.Ce, St.La, St.Nd, St.Pr) (abbreviated as "St.Re" in Table 9) 0.8 wt % (not included in the total number) were mixed with iron powder 99 wt %. (Ce 6.2 wt %, La 3.4 wt %, Nd 1.8 wt %, Pr 0.6 wt %) This mixed powder (fill of 1.5 to 2.5 g) was molded into a specimen of approximately 10.03 mmϕ×2.74 to 4.56 mmH at a molding pressure of 6 t/cm$^2$.

In order to judge the moldability, details regarding the relationship of the green density (GD) and molding pressure of each compact are shown in Table 9 (samples No. 71 to 78).

The moldability of mixed powder was evaluated regarding these specimens under the same conditions as Example 1, and the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 9.

As with Example 1, this sintered body was set inside a temperature and humidity controlled bath, and subject to a humidity oxidation test by performing an atmospheric exposure test in an atmosphere at a temperature of 40° C. and humidity of 90% for 336 hours. The humidity oxidation test results are shown in Table 2.

TABLE 9

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 71 | St. Re | 1.5 | 6 | 420 | 10.03 | 2.76 | 1.52 | 6.97 | 10.03 | 2.76 | 1.51 | 6.93 |
| 72 | | 1.5 | 6 | 420 | 10.03 | 2.74 | 1.51 | 6.98 | 10.03 | 2.75 | 1.49 | 6.86 |
| 73 | | 2.5 | 6 | 420 | 10.03 | 4.56 | 2.52 | 7.00 | 10.03 | 4.55 | 2.48 | 6.90 |
| 74 | | 2.5 | 6 | 420 | 10.03 | 4.54 | 2.51 | 7.00 | 10.03 | 4.54 | 2.48 | 6.92 |
| 75 | | 2.5 | 6 | 420 | 10.03 | 4.53 | 2.50 | 6.99 | 10.03 | 4.53 | 2.47 | 6.90 |
| 76 | | 2.5 | 6 | 420 | 10.03 | 4.55 | 2.51 | 6.99 | 10.03 | 4.52 | 2.47 | 6.92 |
| 77 | | 2.5 | 6 | 420 | 10.03 | 4.54 | 2.50 | 6.97 | 10.03 | 4.51 | 2.47 | 6.94 |
| 78 | | 2.5 | 6 | 420 | 10.03 | 4.52 | 2.49 | 6.98 | 10.03 | 4.47 | 2.45 | 6.94 |

Comparative Example 5

Further, additive free iron powder (Hoganas reduced iron powder (fill of 1.5 to 2.5 g)) was molded into a specimen of approximately 10.02 to 10.04 mmϕ×2.75 to 4.60 mmt at a molding pressure 6 t/cm$^2$. Similarly, in order to the moldability, details regarding the relationship of the green density (GD) and molding pressure of each compact are shown in Table 10 (samples No. 81 to 88).

Moreover, the compact formed on the foregoing specimen was sintered in a batch-type atmospheric furnace at a sintering temperature of 1150° C. and sintering time of 60 minutes under a hydrogen gas atmosphere. The sintered body density (SD) and so on are similarly shown in Table 10.

As with Example 1, this sintered body was set inside a temperature and humidity controlled bath, and subject to a humidity oxidation test by performing an atmospheric exposure test in an atmosphere at a temperature of 40° C. and humidity of 95% for 336 hours. The humidity oxidation test results are shown in Table 2.

TABLE 10

| | | | | Pressure | Before Sintering | | | | After Sintering at 1150° C., 1 hr, under H2 | | | |
|---|---|---|---|---|---|---|---|---|---|---|---|---|
| No. | Soap | Fill g | Pressure t · cm$^{-2}$ | (Device) kgf · cm$^{-2}$ | ϕ mm | t mm | w g | GD g/cc | ϕ mm | t mm | w g | SD g/cc |
| 81 | Additive | 1.5 | 6 | 420 | 10.02 | 2.75 | 1.51 | 6.97 | 10.05 | 2.76 | 1.49 | 6.81 |
| 82 | Free | 1.5 | 6 | 420 | 10.02 | 2.77 | 1.50 | 6.87 | 10.04 | 2.76 | 1.52 | 6.96 |
| 83 | | 2.5 | 6 | 420 | 10.02 | 4.60 | 2.53 | 6.98 | 10.04 | 4.60 | 2.51 | 6.90 |
| 84 | | 2.5 | 6 | 420 | 10.04 | 4.58 | 2.54 | 7.01 | 10.04 | 4.58 | 2.52 | 6.95 |
| 85 | | 2.5 | 6 | 420 | 10.02 | 4.56 | 2.51 | 6.98 | 10.04 | 4.56 | 2.49 | 6.90 |
| 86 | | 2.5 | 6 | 420 | 10.03 | 4.55 | 2.51 | 6.99 | 10.04 | 4.54 | 2.50 | 6.96 |
| 87 | | 2.5 | 6 | 420 | 10.03 | 4.54 | 2.50 | 6.97 | 10.04 | 4.54 | 2.48 | 6.90 |
| 88 | | 2.5 | 6 | 420 | 10.03 | 4.51 | 2.49 | 6.99 | 10.04 | 4.51 | 2.47 | 6.92 |

As evident from Table 1 to Table 10, roughly the same green density is obtained from the evaluation results of compressibility. Further, the extraction pressure (kg) after molding is shown in Table 11, and the compact added with the metallic soap of the present invention has low extraction pressure in comparison to those without any additive, and roughly the same extraction pressure is obtained as in the case of adding zinc stearate.

As described above, it is evident that Example 1 to Example 4 added with the metallic soap of the present invention have roughly the same lubricating ability and moldability as Comparative Example 1 added with the zinc stearate lubricant.

TABLE 11

| | | Extraction pressure (kg) | | |
|---|---|---|---|---|
| | Kinds of Soap | 5 t/cm$^2$ | 6 t/cm$^2$ | 7 t/cm$^2$ |
| Example 1 | St. Sn | 357 | 358 | 406 |
| Example 2 | St. Ag | 339 | 373 | 467 |
| Example 3 | St. Bi | 316 | 350 | 383 |
| Example 4 | St. Co | 322 | 382 | 429 |
| Comparative Example 1 | St. Zn | 306 | 387 | 398 |
| Comparative Example 2 | St. Sr | 338 | 362 | 378 |
| Comparative Example 3 | St. Ba | 280 | 348 | 354 |
| Comparative Example 4 | St. Re | 298 | 374 | 380 |
| Comparative Example 5 | Additive Free | 464 | 890 | 958 |

Next, as clear from Table 2, with Example 5 where a lubricant is not added to the iron powder, in the humidity oxidation resistance test after sintering, discoloration (corrosion) occurred 96 hours (4 days) later, and the degree of discoloration increased gradually pursuant to the lapse of time, and resulted in severe discoloration after the lapse of 336 hours.

Meanwhile, the strontium stearate of Comparative Example 2 showed even more discoloration than the additive free Comparative Example 5, and resulted in sever discoloration pursuant to the lapse of time. Further, the stearic acid (Ce, La, Nd, Pr) (rare earth) of Comparative Example 4 showed severe discoloration even after 96 hours (4 days). As described above, it is evident that the strontium stearate of Comparative Example 2 and the stearic acid (Ce, La, Nd, Pr) (rare earth) of Comparative Example 4 have a lower rust prevention effect than cases without any additives.

Meanwhile, the addition of zinc stearate in Comparative Example 1 and the addition of barium stearate in Comparative Example 3 were roughly the same as the additive free Comparative Example 5 even after the lapse of 336 hours, and it is clear that the addition of zinc stearate and barium stearate have no effect in the humidity oxidation resistance.

Contrarily, Example 1 to Example 4 added with the metallic soap of the present invention merely show slight discoloration in the foregoing humidity oxidation resistance test even after the lapse of 336 hours, and it is evident that they possess humidity oxidation resistance.

Incidentally, although not specifically described, examples for the cases of adding at least one or more types of metallic soap selected from a group of Au, Cu, Mo, Ni, Pd, Pt, Te and W, and the cases of compound additions thereof, showed similar results as Example 1 to Example 4.

Accordingly, it has been confirmed that the mixed powder for powder metallurgy obtained by adding the metallic soap of the present invention to the iron-based metal powder for powder metallurgy has favorable moldability, and is also superior in moisture resistance and oxidation resistance.

As described above, as a result of obtaining mixed powder for powder metallurgy by adding the metallic soap of the present invention to iron-based metal powder for powder metallurgy, the rust prevention effect of sintered bodies can be exponentially improved without changing the conventional sintered body manufacturing process, and this is extremely effective for various sintered bodies such as sintered machine parts, sintered oil retaining bearings and metal graphite brushes.

The invention claimed is:

1. Iron-based metal powder for powder metallurgy, consisting of an iron-based metal powder mixed with a metallic soap selected from a group consisting of silver (Ag) soap, gold (Au) soap, bismuth (Bi) soap, palladium (Pd) soap, platinum (Pt) soap, tellurium (Te) soap, tungsten (W) soap, and mixtures thereof having a higher standard oxidation potential than iron.

2. An iron-based sintered body having a rust prevention function prepared by a process comprising the steps of:

adding a metallic soap selected from the group consisting of silver (Ag) soap, gold (Au) soap, bismuth (Bi) soap, palladium (Pd) soap, platinum (Pt) soap, tellurium (Te) soap, tungsten (W) soap, and mixtures thereof having a higher standard oxidation potential than iron to an iron-based metal powder for powder metallurgy, mixing the metallic soap with the iron-based metal powder to form a mixture, molding the mixture to form a compact, and sintering the compact to form the iron-based sintered body, wherein the sintered body consists of said metallic soap and said iron-based metal.

3. A method of making an iron-based sintered body, comprising the steps of:

adding a metallic soap selected from the group consisting of silver (Ag) soap, gold (Au) soap, bismuth (Bi) soap, palladium (Pd) soap, platinum (Pt) soap, tellurium (Te) soap, tungsten (W) soap, and mixtures thereof having a higher standard oxidation potential than iron to an iron-based metal powder, dispersing the metallic soap within the iron-based metal powder by mixing the metallic soap with the iron-based metal powder to form a mixture, molding the mixture to form a compact, and sintering the compact to form the iron-based sintered body such that the sintered body consists of said metallic soap and said iron-based metal.

4. An iron-based metal powder for powder metallurgy according to claim 1, wherein said metallic soap is in powder form that is evenly dispersed within said iron-based metal powder.

5. An iron-based metal powder for powder metallurgy according to claim 4, wherein said metallic soap contains at least one of Ag, Au, Bi, Pd, Pt and Te.

6. An iron-based metal powder for powder metallurgy according to claim 4, wherein said iron-based metal powder consists of copper powder, graphite powder and iron powder, such that the iron-based metal powder for powder metallurgy consists of copper powder, graphite powder, iron powder and said metallic soap powder.

7. An iron-based sintered body according to claim 2, wherein said metallic soap is in powder form, and during said mixing step, is evenly dispersed within said iron-based metal powder.

8. An iron-based sintered body according to claim 7, wherein said metallic soap contains at least one of Ag, Au, Bi, Pd, Pt and Te.

9. An iron-based sintered body according to claim 7, wherein said iron-based metal powder consists of copper powder, graphite powder and iron powder, such that the iron-based sintered body consists of copper, graphite, iron and said metallic soap.

10. A method according to claim 3, wherein said metallic soap is in the form of a powder, and wherein said dispersing step is accomplished by mixing the metallic soap powder with the iron-based metal powder.

11. A method according to claim 10, wherein said metallic soap contains at least one of Ag, Au, Bi, Pd, Pt and Te.

12. A method according to claim 10, wherein the method consists of said adding, dispersing, molding and sintering steps.

13. A method according to claim 12, wherein said iron-based metal powder consists of copper powder, graphite powder and iron powder, and wherein said dispersing step consists of mixing together the copper powder, graphite powder, iron powder and metallic soap powder.

* * * * *